US005669140A

United States Patent [19]

Tsumura

[11] Patent Number: 5,669,140

[45] Date of Patent: Sep. 23, 1997

[54] CHAIN SAW GUIDE BAR HAVING A LUBRICANT FEEDING STRUCTURE

[75] Inventor: Seijiro Tsumura, Hyogo, Japan

[73] Assignee: Suehiro Seiko Kabushiki Kaisha, Hyogo, Japan

[21] Appl. No.: 527,586

[22] Filed: Sep. 13, 1995

[30] Foreign Application Priority Data

Sep. 13, 1994 [JP] Japan ..... 6-218520

[51] Int. Cl.[6] ..... B27B 17/12

[52] U.S. Cl. ..... 30/123.4; 30/383

[58] Field of Search ..... 30/123.4, 123.3, 30/383, 387

[56] References Cited

U.S. PATENT DOCUMENTS

| | | | |
|---|---|---|---|
| 4,947,550 | 8/1990 | Wenzel | 30/123.4 |
| 5,025,561 | 6/1991 | Sugihara et al. | 30/387 |
| 5,035,058 | 7/1991 | Date et al. | 30/387 |
| 5,050,303 | 9/1991 | Sinclair et al. | 30/123.4 |
| 5,056,224 | 10/1991 | Seigneur . | |

FOREIGN PATENT DOCUMENTS

| | | | |
|---|---|---|---|
| 908296 | 2/1954 | Germany | 30/123.4 |
| 5-309604 | 11/1993 | Japan . | |
| 6-16003 | 3/1994 | Japan . | |
| 6-87101 | 3/1994 | Japan . | |
| 6-45704 | 6/1994 | Japan . | |

*Primary Examiner*—Hwei-Siu Payer
*Attorney, Agent, or Firm*—Oblon, Spivak, McClelland, Maier & Neustadt, P.C.

[57] ABSTRACT

A chain saw guide bar having a lubricant feeding structure is capable of providing sufficient lubrication to the guide bar tip portion and has sufficient strength and durability during use over an extended period of time and, at the same time, has the weight of the guide bar reduced. The chain saw guide bar is made of a single plate and is provided with a lubricant supply port made in a base end portion of the guide bar surface, a bottomed recess groove running continuously from the lubricant supply port to a tip portion and bottomed holes located on the bottomed recess groove. The side walls of the holes and the recess groove are tilted to increase the widths of the cross sections of the recess groove and the hole toward the bottom. A hollow pipe runs continuously from the lubricant supply port to the tip portion and is installed in the recess groove and in the holes, while the recess groove and the holes are filled with a light-weight filling material such as a synthetic resin to thereby consolidate the hollow pipe integrally with the guide bar.

16 Claims, 7 Drawing Sheets

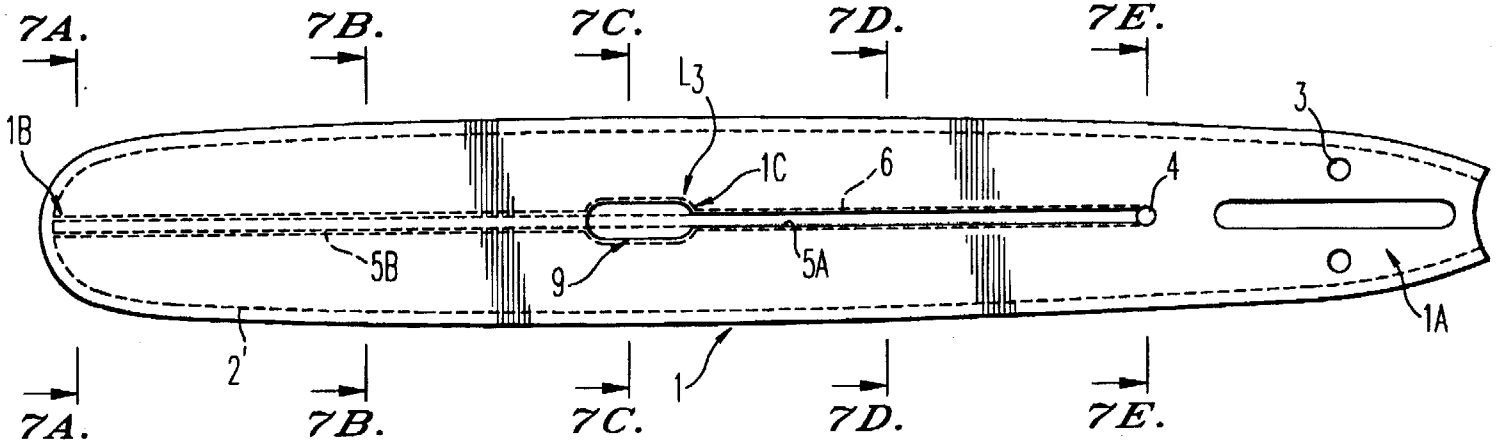
FIG. 6
FIG. 7A
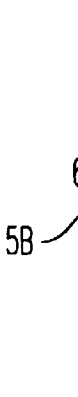
FIG. 7B
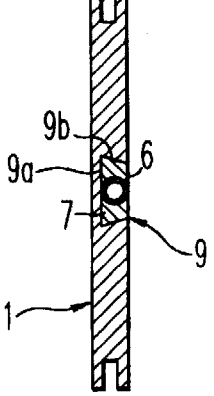
FIG. 7C
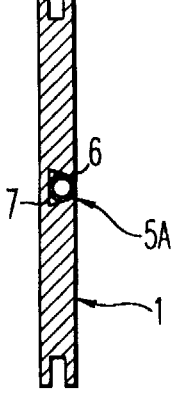
FIG. 7D
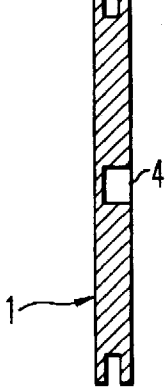
FIG. 7E

CHAIN SAW GUIDE BAR HAVING A LUBRICANT FEEDING STRUCTURE

BACKGROUND OF THE INVENTION

1. Field of the Invention

The present invention relates to a structure for supplying lubricant to the tip portion of a guide bar of a chain saw used in cutting wooden objects, concrete structures, building stones and the like, and in cutting off plants in the soil, and more particularly, a lubricant supplying structure for the chain saw guide bar wherein the lubricant feeding structure and the guide bar have the weight thereof reduced.

2. Discussion of the Related Art

A conventional chain saw consists mainly of an engine housing incorporating a motor (engine, electric motor, etc.), a guide bar fixed on the engine housing and a saw chain which runs along a guide groove made on the periphery of the guide bar.

The guide bar may be, for example, a general purpose chain saw guide bar comprising a single steel plate made in an elongated ellipse having a thickness of about 5 mm, a width of about 50 to 150 mm and length of about 300 to 1500 mm, and accounts for the largest part of the weight of the chain saw.

A guide bar having the shape of elongated ellipse has a guide groove being machined on the periphery thereof and the saw chain runs at a high speed along the guide groove, and therefore it is generally necessary to supply a lubricant to the slide way between the guide groove and the saw chain in order to facilitate lubrication as well as prevent heat generation due to friction.

Related arts in this field include U.S. Pat. No. 5,056,224. The invention disclosed in this publication provides a guide bar comprising a center plate and external plates laminated on both sides of the center plate in a 3-layer structure, wherein part of the center plate is cut off in the longitudinal direction to make a gap and forming the gap into a lubricant passage thereby providing lubrication for the saw chain (related art 1).

Another related arrangement is Japanese Patent Unexamined Publication No. Hei 5-309604. The invention disclosed in this publication provides a guide bar comprising a single plate having a through hole formed therein while inserts which are made of a more light-weight material than the guide bar and have a number of discharge holes made therein are fitted into the through hole from both sides of the guide bar, thereby integrating them into a single having the weight reduced and a lubricant is injected into a hollow space between the inserts to lubricate the side face of the guide bar (related art 2).

Further another related arrangement is Japanese Patent Unexamined Publication No. Hei 6-87101. The invention disclosed in this publication provides a guide bar comprising a single plate with at least one side face thereof and has a groove formed thereon, while a detachable lid member is fitted in the groove to form a lubricant passage, thereby lubricating the guide bar side face (related art 3).

Although there is also a proposal disclosed in the Japanese Utility Model Publication No. Hei 6-16003, this invention is similar to related art 1 described above in that a part of a center plate of 3-layer structure is cut off to form a groove which functions as a lubricant passage, while a member made of a transparent material for confirming the state of lubricant supply is installed at a position corresponding to the groove, thereby confirming the flowing condition of the lubricant that flows in the passage (related art 4).

In the case of related art 1, because the guide bar is of a 3-layer structure with part of the center plate being cut off to form the lubricant passage, a gap is likely to form in the bonding interface between the external plates and the center plate so that the lubricant leaks from the gap to make efficient lubrication impossible. There may also occur such a case that cut chips, dust or the like enter through the gap and block the lubricant passage to stop the lubricating function, in which case the chain saw becomes inoperable due to seizure or other failure due to overheat. Moreover, cutting off part of the center plate decreases the strength of the guide bar.

In the case of related art 2, because the inserts having a number of discharge holes are fitted in the guide bar on both sides thereof to form a single body and provide lubrication, the tip portion of the guide bar cannot be lubricated well. Even when a passage to the tip portion is provided, cut chips, dust or the like enter through the discharge holes and block the passage thereby stopping the lubricating function and causing the chain saw to become inoperable due to seizure or other failure due to overheat caused by lubrication failure. Moreover, there is a possibility that the inserts disintegrate and scatter due to the impact transmitted from the side face of the guide bar after operations over an extended period of time, in which case the operation must be interrupted for repair, resulting in decreased productivity. In addition, because the guide bar has through holes on the side face, strength of the guide bar is decreased.

In the case of related art 3, the invention does not provide satisfactory lubrication at the tip portion of the guide bar similarly to related art 2. Even when a passage to the tip portion is provided, there is a possibility that the lid member disintegrates and scatters due to the impact transmitted from the side face of the guide bar after operations over an extended period of time, in which case the operation must be interrupted for repair, resulting in decreased productivity.

In the case of related art 4, because the invention is a guide bar of 3-layer structure similarly to related art 1, there is a possibility of the lubricant leaking through gaps in the bonding interface between the external plates and the center plate so that efficient lubrication cannot be performed. There may also occur such a case that cut chips, dust or the like enter through the gaps and block the lubricant passage to stop the lubricating function, in which case the chain saw becomes inoperable due to seizure or other failure caused by overheating. Moreover, cutting off part of the center plate decreases the strength of the guide bar. Furthermore, the structure of installing the member made of a transparent material for the confirmation of the state of lubricant flow in the lubricant flow passage is complicated and the installation of the lubricant flow confirming member causes the strength of the guide bar to decrease.

SUMMARY OF THE INVENTION

An object of the present invention is to solve the problems of the related art as described above. The present invention provides for a chain saw guide bar having lubricant feeding structure which is capable of providing satisfactory lubrication to the tip portion of the guide bar while having sufficient strength and durability in operations over an extended period of time, and to provide for a lubricant feeding structure for a chain saw guide bar wherein the weight of the guide bar itself can be reduced.

In order to achieve the objects described above, the present invention provides for a chain saw guide bar having 2 lubricant feeding structure which is made of a single plate and comprises a lubricant supply port made in the base end portion of the guide bar surface; a bottomed recess groove running continuously from the lubricant supply port to the tip portion with the side walls of the recess groove tilted to increase the width of the cross section of the groove toward the bottom; and a hollow pipe running continuously from the lubricant supply port to the tip portion being installed in the recess groove. The recess groove is filled with a light-weight filling material such as a synthetic resin to thereby consolidate the hollow pipe integrally with the guide bar.

The present invention also provides for a chain saw guide bar having a lubricant feeding structure which is made of a single metal plate and comprises a lubricant supply port made in the base end portion of the guide bar surface; a bottomed recess groove running continuously from the lubricant supply port to the tip portion and bottomed holes located on the bottomed recess groove with the side walls of the recess groove and the bottomed holes tilted to increase the widths of the cross sections of the groove and the holes toward the bottom; and a hollow pipe running continuously from the lubricant supply port to the tip portion being installed in the recess groove and the holes. The recess groove and the holes are filled with a light-weight filling material such as a synthetic resin to thereby consolidate the hollow pipe integrally with the guide bar.

The present invention further provides for a chain saw guide bar having a lubricant feeding structure which is made of a single metal plate and comprises a lubricant supply port made in the base portion of the guide bar on one side thereof; a bottomed recess groove running continuously from the lubricant supply port to the mid-portion; a bottomed recess groove running continuously from the mid-portion to the tip portion on the opposite side of the guide bar surface; a bottomed hole made at the mid-portion of the surface on one side of the guide bar to connect the two recess grooves, with the side walls of the recess grooves and the hole being tilted to increase the widths of the cross sections of the grooves and the hole toward the bottom; and a hollow pipe running continuously from the base end portion to the tip portion being installed in the recess grooves and the hole. The recess grooves and the hole are filled with a light-weight filling material such as a synthetic resin to thereby consolidate the hollow pipe integrally with the guide bar.

The present invention further provides for a chain saw guide bar having a lubricant feeding structure which is made of a single metal plate and comprises lubricant supply ports made in the base end portion on both sides of the guide bar; bottomed recess grooves running continuously from the lubricant supply ports to the tip portion and bottomed holes located on the bottomed recess grooves with the side walls of the recess grooves and the bottomed holes being tilted to increase the widths of the cross sections of the grooves and the holes toward the bottom; and hollow pipes running continuously from the lubricant supply ports to the tip portion being installed in the recess grooves and the holes. The recess grooves and the holes are filled with a light-weight filling material such as a synthetic resin to thereby consolidate the hollow pipes integrally with the guide bar.

The present invention further provides for a chain saw guide bar having a lubricant feeding structure for a chain saw guide bar which is made of a single metal plate and comprises a lubricant supply port made in the base end portion on one side of the guide bar; a bottomed recess groove running continuously from the lubricant supply port to the tip portion and bottomed holes grooved on both sides of the guide bar to connect to the bottomed recess groove with the side walls of the recess groove and the bottomed holes being tilted to increase the widths of the cross sections of the groove and the holes toward the bottom; and a hollow pipe running continuously from the lubricant supply port to the tip portion being installed in the recess groove and the holes. The recess groove and the holes are filled with a light-weight filling material such as a synthetic resin to thereby consolidate the hollow pipe integrally with the guide bar.

The present invention further provides for a chain saw guide bar having a lubricant feeding structure for a chain saw guide bar, wherein the chain saw guide bar comprises a single metal plate having a sprocket in the tip portion; and a bottomed recess groove is made to run continuously to the tip portion near the sprocket.

In the chain saw guide bar having a lubricant feeding structure of the present invention, a dust-proof filter can be installed in the hollow pipe at the end thereof.

According to the chain saw guide bar having a lubricant feeding structure of the present invention, because the hollow pipe running continuously from the lubricant supply port to the tip portion is installed in the bottomed recess groove that runs continuously from the lubricant supply port made in the base end portion of the guide bar surface of the single plate structure to the tip portion thereof, and the recess groove is filled with a light-weight filling material such as a synthetic resin to thereby consolidate the hollow pipe integrally with the guide bar, the external shape can be made similar to a chain saw guide bar made of a single plate, and the lubricant can be supplied to the tip portion of the guide bar through the hollow pipe that runs continuously from the lubricant supply port to the tip portion.

Also because the side walls of the recess groove are tilted to increase the width of the grove toward the bottom, the light-weight filling material that fills the recess groove is stabilized so that it does not come off.

With the chain saw guide bar having a lubricant feeding structure of the present invention, because the hollow pipe running continuously from the lubricant supply port to the tip portion is installed in the bottomed recess groove that runs continuously from the lubricant supply port made in the base end portion of the guide bar surface of the single metal plate structure to the tip portion, and the recess groove and the holes are filled with a light-weight filling material such as a synthetic resin to thereby consolidate the hollow pipe integrally with the guide bar, the external shape can be made similar to a chain saw guide bar made of a single metal plate and the lubricant can be supplied to the tip portion of the guide bar through the hollow pipe that runs continuously from the lubricant supply port to the tip portion.

Also because the side walls of the recess groove and the holes are tilted to increase the widths of the groove and the holes toward the bottom, the light-weight filling material that fills the recess groove and the holes is stabilized so that it does not come off. Further, the bottomed holes made on the bottomed recess groove enable it to reduce the weight of the guide bar and to keep the entire light-weight filling material consolidated in a single body.

According to the chain saw guide bar having a lubricant feeding structure of the present invention, because the hollow pipe running continuously from the lubricant supply port to the tip portion is installed in the bottomed recess grooves, one running continuously from the lubricant supply port made in the base end portion to the mid-portion of the guide bar surface of the single metal plate structure on one side thereof and another running continuously from the mid-portion to the tip portion, and in the bottomed hole that connects the recess grooves at the mid-portion, and the recess grooves and the hole are filled with a light-weight filling material such as a synthetic resin to thereby consolidate the hollow pipe integrally with the guide plate, the external shape can therefore be made similar to a chain saw guide bar made of a single metal plate and the lubricant can be supplied to the end portion of the guide bar through the hollow pipe that runs continuously from the lubricant supply port to the end portion.

Also because the side walls of the recess grooves and the hole are tilted to increase the widths of the grooves and the hole toward the bottom, the light-weight filling material that fills the recess grooves and the hole is stabilized so that it does not come off. Further, the bottomed hole that connects the bottomed recess grooves enables it to reduce the weight of the guide bar and to keep the entire light-weight filling material consolidated in a single body.

According to the chain saw guide bar having a lubricant feeding structure of the present invention, because the hollow pipes running continuously from the lubricant supply ports to the tip portion are installed in the bottomed recess grooves that run continuously from the lubricant supply ports made in the base end portion of the guide bar of the single metal plate structure on both sides thereof and in the bottomed holes installed on the recess grooves, and the recess grooves and the holes are filled with a light-weight filling material such as a synthetic resin to thereby consolidate the hollow pipes integrally with the guide plate, the external shape can be made similar to a chain saw guide bar made of a single metal plate, and the lubricant can be supplied to the end portion of the guide bar through the hollow pipes that run continuously from the lubricant supply ports to the tip portion.

Also because the side walls of the recess grooves and the holes are tilted to increase the widths of the grooves and the holes toward the bottom, the light-weight filling material that fills the recess groove and the holes is stabilized so that it does not come off. Further, the bottomed holes made on the bottomed recess grooves enable it to reduce the weight of the guide bar and to keep the entire light-weight filling material consolidated in a single body.

According to the chain saw guide bar having a lubricant feeding structure of the present invention, because the hollow pipe running continuously from the lubricant supply port to the tip portion is installed in the bottomed recess groove that runs continuously from the lubricant supply port made in the base portion of the guide bar of the single metal plate structure on one side thereof and in the bottomed holes made from both sides to connect to the recess groove, and the recess groove and the holes are filled with a light-weight filling material such as a synthetic resin to thereby consolidate the hollow pipe integrally with the guide bar, the external shape can be made similar to a chain saw guide bar made of a single metal plate and the lubricant can be supplied to the tip portion of the guide bar through the hollow pipe that runs continuously from the lubricant supply port to the tip portion.

Also because the side walls of the recess groove and the holes are tilted to increase the widths of the groove and the holes toward the bottom, the light-weight filling material that fills the recess groove and the holes is stabilized so that it does not come off. Further, the bottomed holes made on both sides to connect to the bottomed recess groove enable it to reduce the weight of the guide bar and to keep the entire light-weight filling material consolidated in a single body.

According to the chain saw guide bar having a lubricant feeding structure of the present invention, in the chain saw guide bar made of a single metal plate having a sprocket at the tip portion, the lubricant can be supplied to the tip portion of the guide bar through the hollow pipe by means of the bottomed recess groove made to run to the tip portion near the sprocket.

According to the chain saw guide bar having a lubricant feeding structure of the present invention, entry of cut chips and the like into the hollow pipe can be prevented by means of the dust-proof filter installed at the end of the hollow pipe.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6 is a side view showing a third embodiment of the invention;

FIGS. 7(*a*), 7(*b*), 7(*c*), 7(*d*) and 7(*e*) are a set of sectional views of FIG. 6, FIG. 7(*a*) showing the 7*a*—7*a* section, FIG. 7(*b*) showing the 7*b*—7*b* section, FIG. 7(*c*) showing the 7*c*—7*c* section, FIG. 7(*d*) showing the 7*d*—7*d* section and FIG. 7(*e*) showing the 7*e*—7*e* section;

DESCRIPTION OF THE PREFERRED EMBODIMENTS

Figure 1:
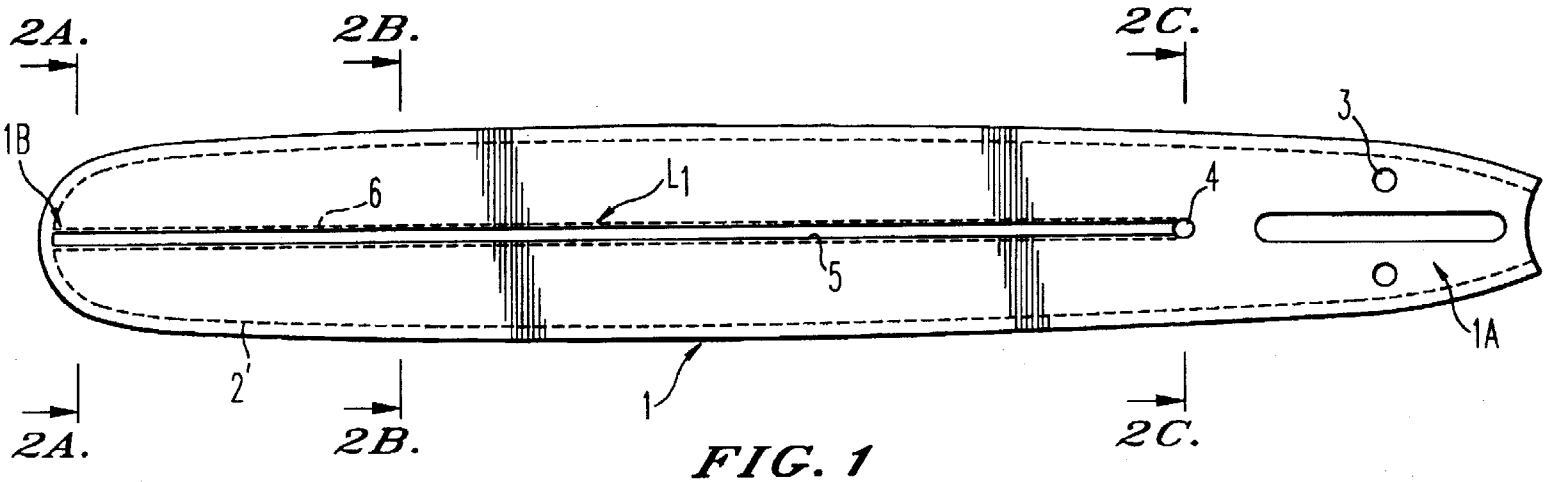
FIG. 1 is a side view of a first embodiment of the invention.
Figure 2C:
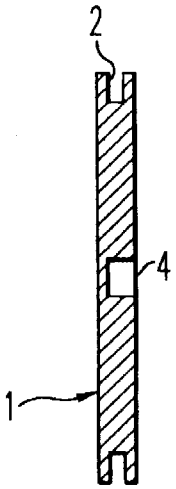
FIGS. 2(*a*), 2(*b*) and 2(*c*) are a set of sectional views of FIG. 1, FIG. 2(*a*) showing the 2*a*—2*a* section, FIG. 2(*b*) showing the 2*b*—2*b* section and FIG. 2(*c*) showing the 2*c*—2*c* section.
Figure 3:
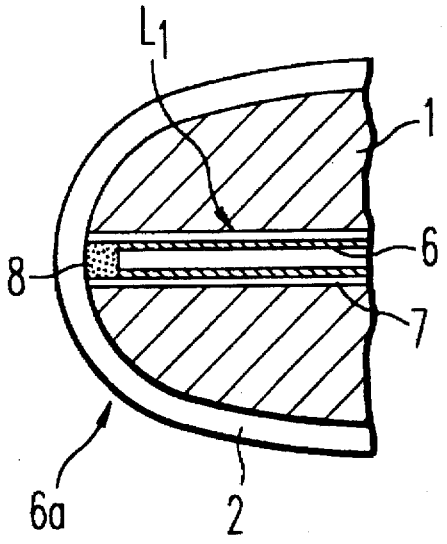
FIG. 3 is a sectional view of the guide bar end portion of FIG. 1.

Referring now to the drawings, wherein like reference numerals designate identical or corresponding parts throughout the several views, FIG. 1 is a side view showing the first embodiment, with FIGS. 2(*a*)–2(*c*) being sectional views thereof. FIG. 2(*a*) shows the view in 2*a*—2*a* section, FIG. 2(*b*) shows the view in 2*b*—2*b* section and FIG. 2(*c*)

shows the view in the 2c—2c section. FIG. 3 is a sectional view at the tip portion of the guide bar.

As shown in the drawings, a guide bar 1 made of a single plate has a guide groove 2 machined along the periphery thereof in order to guide a saw chain not shown in the drawing, and is provided with a support portion 3 for fastening the guide bar on the engine housing and a bottomed lubricant supply port 4 at a base end portion 1A. The guide bar 1 is made of such a material as, for example, a metal or a synthetic resin.

Figure 2B:
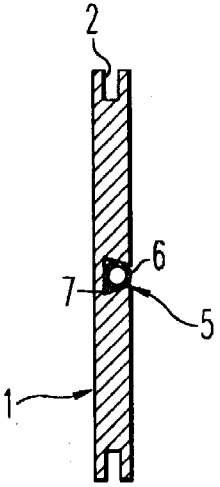
Figure 2A:
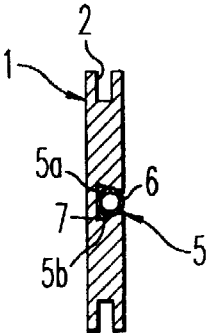

The guide bar 1 also has a bottomed recess groove 5 that runs continuously in the longitudinal direction from the lubricant supply port 4 to a tip portion 1B, while the recess groove 5 is formed so that side walls 5b are tilted to increase the width of the groove toward a bottom 5a with a specified thickness being kept below the bottom 5a as shown in the sectional views of FIGS. 2(a) and 2(b). That is, the side walls 5b of the recess groove are tapered to increase the inner space toward the bottom 5a.

A hollow pipe 6 (lubricant supply pipe) is installed in the recess groove 5 to run continuously from the lubricant supply port 4 to the tip portion 1B, while the space between the hollow pipe 6 and the recess groove 5 is filled with a light-weight filling material 7, which is relatively light weight such as synthetic resin, to consolidate the hollow pipe 6 integrally with the guide bar 1, while the surface of the recess groove 5 is made flush with the surface of the guide bar 1.

By making the hollow pipe 6, for example, by pressing a metal pipe having a diameter greater than the depth of the recess groove 5 to deform it into an elliptic shape and installing it in the recess groove 5, with the remaining space in the recess groove 5 being filled with the light-weight filling material 7 such as synthetic resin thereby making the surface thereof flush with the surface of the guide bar surface, the deformed pipe 6 becomes wider than the width of the recess groove 5 at the surface, so that it is made possible to secure the hollow pipe 6 in the recess groove 5. Also the hollow pipe 6 has a dust-proof filter 8 installed at the discharge end 6a thereof as shown in the sectional view of FIG. 3, to prevent the entry of cut chips and the like. The hollow pipe 6 is made preferably of a metal, a synthetic resin or the like having high pressure resistance and high oil resistance, and the outer diameter thereof may be such that can be installed in the recess groove 5, although it is preferable to be nearly equal to or greater than the depth of the recess groove 5. The dust-proof filter 8 is preferably a metal mesh filter or a resin filter which can be installed easily.

The light-weight filling material 7 is formed to be flush with the surface of the guide bar 1 as installed, to thereby become part of the surface of the guide bar 1, and is preferably made of a synthetic resin which is higher in wear resistance, heat resistance and impact resistance, and has a good bonding characteristic, while one having such performance that is similar to that of the guide bar 1 which allows it to act integrally with the guide bar 1 is preferable. The light-weight filling material 7 is securely fixed in the recess groove 5 because the side walls 5b of the recess groove 5 are tapered to increase the inner space toward the bottom 5a.

In case a temperature sensing coloration agent is added to the filling material, the operator can know that the heating of the guide bar 1 during operation has increased the temperature into a dangerous region by the discoloration of the filling material 7, making it possible to prevent the guide bar 1 performance from deteriorating.

Also when the hollow pipe 6 is installed in the recess groove 5 and is consolidated with the guide bar 1 with the light-weight filling material 7, the guide bar 1 has no unevenness on its surface, so that the surface does not receive increased resistance during operation of the chain saw.

According to the chain saw guide bar having a lubricant feeding structure L1 of the first embodiment constituted as described above, the hollow pipe 6 running continuously in the recess groove 5 provided on the guide bar surface allows it to supply a sufficient quantity of lubricant directly to the tip portion 1B of the guide bar from the lubricant supply port 4 installed at the base end portion 1A of the guide bar 1.

Also because the chain saw guide bar can be configured to have an external appearance which is not different from a guide bar comprising a single plate at all, the guide bar can be handled similarly to conventional ones and, because the recess groove 5 is formed so that side walls 5b are tilted to increase the width of the groove toward the bottom 5a, the light-weight filling material 7 does not come off after being used over an extended period of time and shows sufficient strength.

Figure 4:
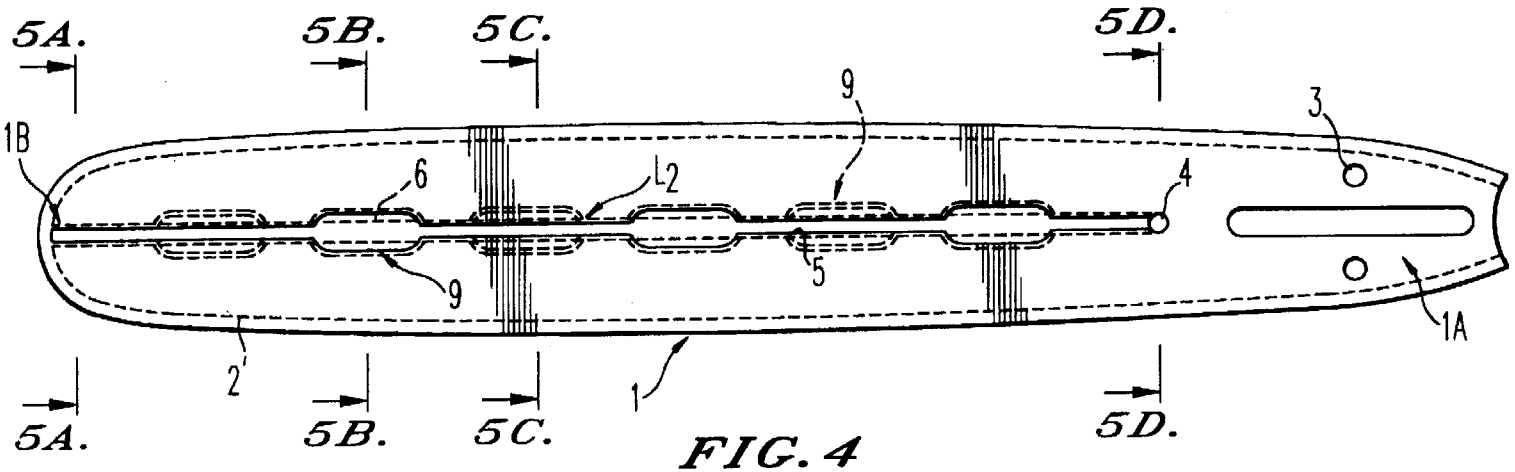
FIG. 4 is a side view showing a second embodiment of the invention.
Figure 5D:
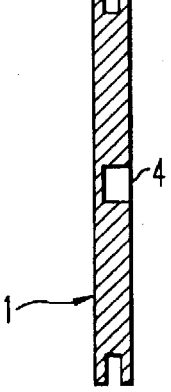
FIGS. 5(*a*), 5(*b*), 5(*c*) and 5(*d*) are a set of sectional views of FIG. 4, FIG. 5(*a*) showing the 5*a*—5*a* section, FIG. 5(*b*) showing the 5*b*—5*b* section, FIG. 5(*c*) showing the 5*c*—5*c* section and FIG. 5(*d*) showing the 5*d*—5*d* section.
Figure 5C:
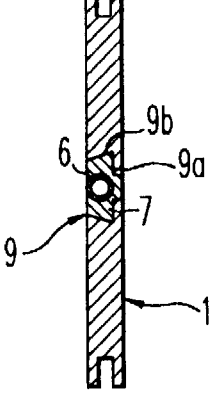
Figure 5B:
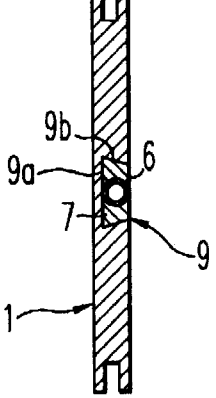
Figure 5A:
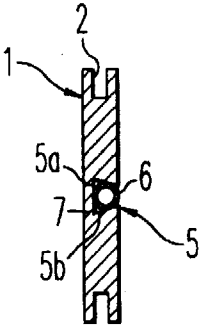

The chain saw guide bar having a lubricant feeding structure of the second embodiment will be described below referring to the side view of FIG. 4 and the sectional views of FIGS. 5(a)–5(d), where FIG. 5(a) shows the view in 5a—5a section, FIG. 5(b) shows the view in 5b—5b section, FIG. 5(c) shows the view in 5c—5c section and FIG. 5(d) shows the view in 5d—5d section. In the second embodiment, the guide bar 1 in the first embodiment is made of a single steel plate and the bottomed holes 9 for the purpose of weight reduction of the guide bar and higher stability of the light-weight filling material 7 are provided on the recess groove 5. Components identical with those of the first embodiment will be denoted with the same numerals and explanation thereof will be omitted.

As shown in the drawings, a guide bar 1 made of a single steel plate has a recess groove 5 formed therein, and a plurality of bottomed holes 9 having shapes of elongated ellipse are made to be positioned over the recess groove 5 by grooving alternately from either side of the guide bar 1 in the longitudinal direction. The holes 9 are formed in a tapered configuration with the side walls 9b tilted to increase the width of the hole toward the bottom 9a similarly to the recess groove 5 described above, so that the light-weight filling material 7 is prevented from coming off.

A hollow pipe 6 which shifts at its mid-portion from the right to left side of the guide bar or vice-versa runs continuously from the lubricant supply port 4 to the tip portion 1B. The hollow pipe 6 is installed in the recess groove 5 and in the holes 9, while the space other than the hollow pipe 6 is filled with a light-weight filling material 7 to consolidate the hollow pipe integrally with the guide bar 1 with the surfaces of the recess groove 5 and the holes 9 being made flush with the surface of the guide bar 1. The filling material 7 is preferably constituted similarly to the case of the first embodiment.

According to the chain saw guide bar having a lubricant feeding structure L2 of the second embodiment constituted as described above, similarly to the first embodiment, the hollow pipe 6 running continuously in the recess groove 5 and in the holes 9 allows it to supply a sufficient quantity of lubricant directly to the tip portion 1B from the lubricant supply port 4 installed at the base end portion 1A of the guide bar 1 and, at the same time, the light-weight filling material 7 that fills the bottomed holes 9 provided on the recess groove 5 enables it to reduce the weight of the guide bar 1 itself.

Also because the guide bar 1 can be configured to have an external appearance which is not different from a guide bar comprising a single steel plate at all, the guide bar 1 can be handled similarly to the conventional ones and, because the recess groove 5 is formed so that side walls 5*b* are tilted to increase the width of the groove toward the bottom 5*a*, the light-weight filling material 7 does not come off after being used over a long period of time and shows sufficient strength.

Also when the holes 9 that connect to the recess groove 5 which is cut on one side of the guide bar 1 are grooved from both sides and consolidated with the light-weight filling material 7 as in this second embodiment, bending due to a strain generated when the guide bar 1 is subjected to a great pressure applied from the side in such a direction as the recess groove 5 is opened, which may occur when the recess groove 5 is made on only one side of the longitudinal direction as in the case of the first embodiment, can be restrained by the toughness of the light-weight filling material 7 provided on both sides as well as the guide bar 1.

The chain saw guide bar having a lubricant feeding structure of the third embodiment will be described below referring to the side view of FIG. 6 and the sectional views of FIGS. 7(*a*)–7(*e*), with FIG. 7(*a*) showing the view in 7*a*—7*a* section, FIG. 7(*b*) showing the view in 7*b*—7*b* section, FIG. 7(*c*) showing the view in 7*c*—7*c* section, FIG. 7(*d*) showing the view in 7*d*—7*d* section and FIG. 7(*e*) showing the view in 7*e*—7*e* section. In the third embodiment, the guide bar 1 is provided with bottomed recess grooves 5 on both sides and a bottomed hole 9 made between the recess grooves to connect the recess grooves. Components identical with those of the first embodiment or the second embodiment will be denoted with the same numerals and explanation thereof will be omitted.

As shown in the drawings, the guide bar 1 made of a single steel plate has a recess groove 5A made on one side thereof running continuously from the lubricant supply port 4 provided at the base end portion 1A to the mid-portion 1C, and a recess groove 5B running continuously from the mid-portion 1C to the tip portion 1B. A bottomed hole 9 being grooved on one side of the guide bar is provided between the recess grooves 5A and 5B. The hole 9 is formed in a tapered configuration with the side walls 9*b* tilted to increase the width of the hole toward the bottom 9*a* similarly to the second embodiment described above, so that the light-weight filling material 7 is prevented from coming off.

The recess grooves 5A and 5B communicate with each other at a mid-portion of the guide bar 1. A hollow pipe 6 running bends at its mid-portion so as to run continuously from the lubricant supply port 4 to the tip portion 1B. That is, the hollow pipe 6 which runs continuously from the hole 9 to the recess groove 5 is installed in the recess grooves 5A, 5B and in the hole 9, while the space other than the hollow pipe 6 is filled with a light-weight filling material 7 to consolidate the hollow pipe 6 integrally with the guide bar 1, and the surfaces of the recess grooves 5A, 5B and the hole 9 are made flush with the surface of the guide bar 1. The filling material 7 is preferably constituted similarly to the case of the first embodiment.

According to the chain saw guide bar having a lubricant feeding structure L3 of the third embodiment constituted as described above, similarly to the second embodiment, the hollow pipe 6 installed in the recess grooves 5A, 5B and the hole 9 allows it to supply a sufficient quantity of lubricant directly to the tip portion 1B from the lubricant supply port 4 installed at the base end portion 1A of the guide bar 1 and, at the same time, the light-weight filling material 7 that fills the bottomed hole 9 provided on the recess grooves 5A, 5B enables it to reduce the weight of the guide bar 1 itself.

In the third embodiment, similarly to the second embodiment, the guide bar 1 can be configured to have an external appearance which is not different from a single steel plate at all, and the light-weight filling material 7 is stabilized in the recess grooves 5 showing sufficient strength even when used over a long period of time.

In the third embodiment, the guide bar 1 is provided with the recess groove 5A being cut to the mid-portion 1C in the longitudinal direction of the guide bar 1 and the recess groove 5B being cut from the mid-portion 1C in the longitudinal direction to the tip portion 1B, on the opposite sides thereby dividing the guide bar 1 in two portions at the center in the longitudinal direction, and the hole 9 is grooved at the mid portion where the recess grooves 5A, 5B on the respective sides meet. The recess grooves and the hole are filled with the light-weight filling material 7 to connect the recess grooves, so that bending due to a strain generated when the guide bar 1 is subjected to a great pressure applied on the side can be restrained by the toughness of the light-weight filling material 7 provided on both sides as well as the guide bar 1, similarly to the second embodiment.

Figure 8A:
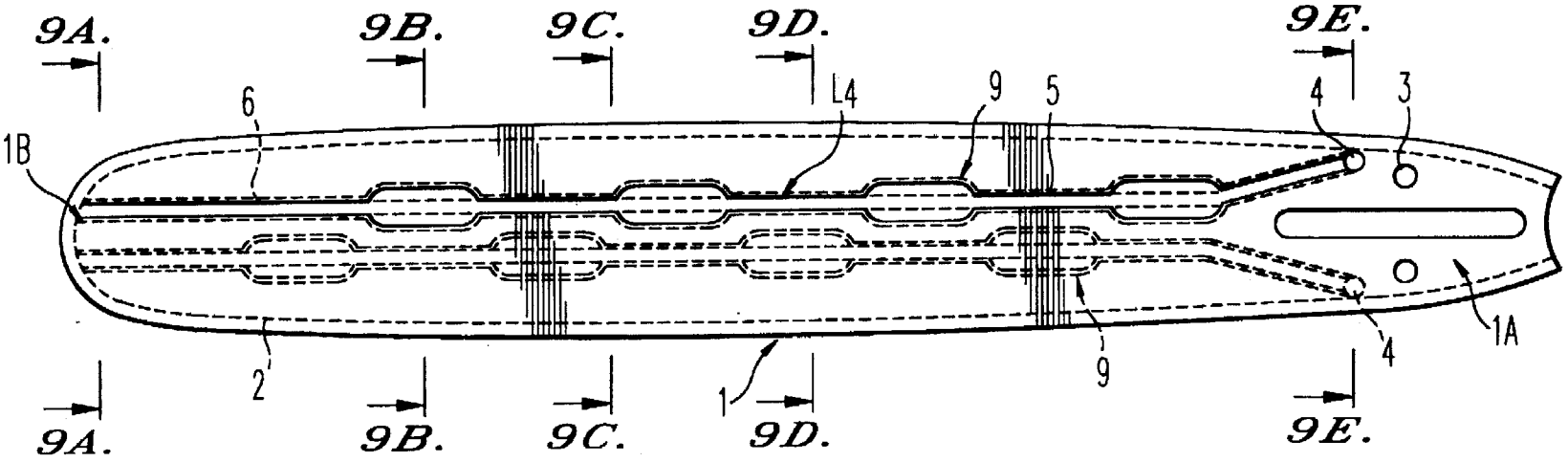
FIGS. 8(*a*) and 8(*b*) are a set of side views showing the fourth embodiment of the invention, FIG. 8(*a*) showing one side view and FIG. 8(*b*) showing another side view.
Figure 8B:
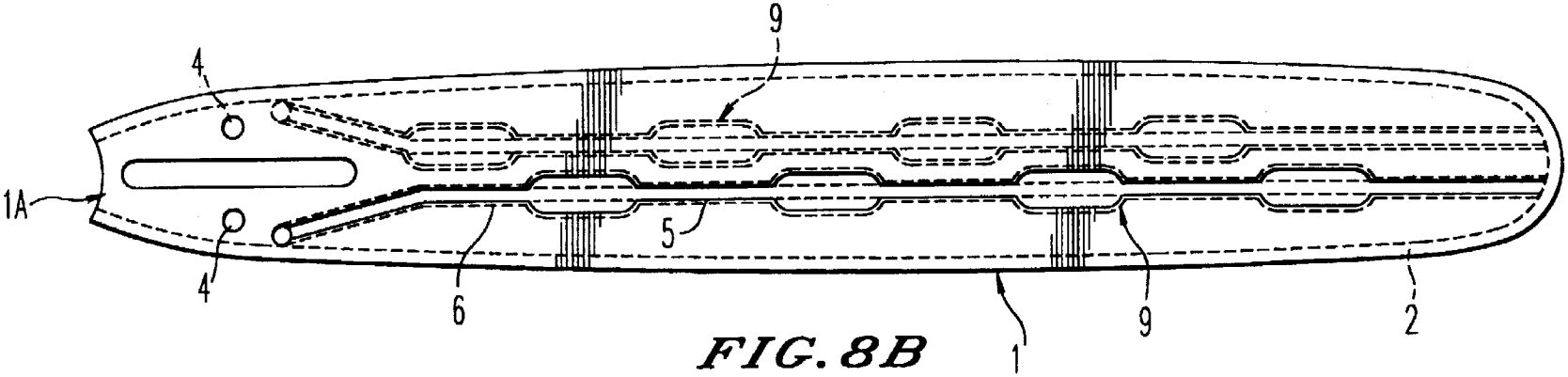
Figure 9E:
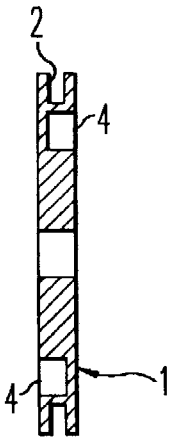
FIGS. 9(*a*), 9(*b*), 9(*c*), 9(*d*) and 9(*e*) are a set of sectional views of FIG. 8*a*, FIG. 9(*a*) showing the 9*a*—9*a* section, FIG. 9(*b*) showing the 9*b*—9*b* section, FIG. 9(*c*) showing the 9*c*—9*c* section, FIG. 9(*d*) showing the 9*d*—9*d* section and FIG. 9(*e*) showing the 9*e*—9*e* section.
Figure 9D:
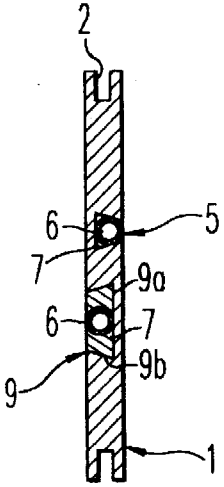
Figure 9C:
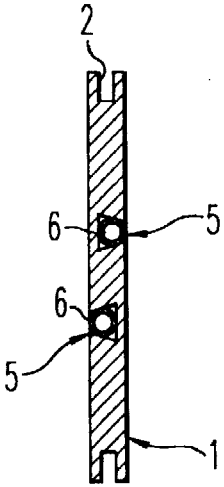
Figure 9B:
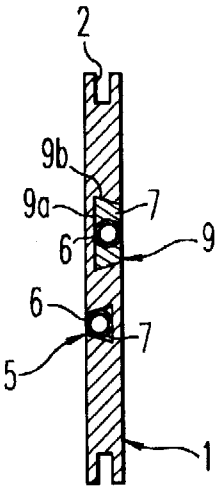
Figure 9A:
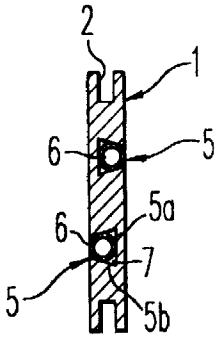

The chain saw guide bar having a lubricant feeding structure of the fourth embodiment will be described below referring to the side views of FIGS. 8(*a*) and 8(*b*) and the sectional views of FIGS. 9(*a*)–9(*e*), where FIG. 9(*a*) shows the view in 9*a*—9*a* section, FIG. 9(*b*) shows the view in 9*b*—9*b* section, FIG. 9(*c*) shows the view in 9*c*—9*c* section, FIG. 9(*d*) shows the view in 9*d*—9*d* section and FIG. 9(*e*) shows the view in 9*e*—9*e* section. In the fourth embodiment, the guide bar 1 is provided with bottomed recess grooves 5 made on both sides thereof at positions offset from the center line in the longitudinal direction of the guide bar 1 with the inner walls tilted to increase the width of the groove toward the bottom and bottomed holes 9 of elongated elliptic shape positioned on the recess grooves 5 with the grooves and the holes consolidated by means of a light-weight filling material 7. Because the light-weight filling material 7 occupies greater volume than in the case of any of the other embodiments described above, the weight of the guide bar 1 is further reduced. Components identical with those of the first embodiment or the second embodiment will be denoted with the same numerals and explanation thereof will be omitted.

As shown in the drawings, the guide bar 1 made of a single steel plate has recess grooves 5 made on both sides thereof running continuously from the lubricant supply port 4 provided at the base end portion 1A to the tip portion 1B, and bottomed holes 9 grooved from one side at specified intervals on each of the recess groove 5. The holes 9 on one side of the guide bar 1 are made at positions staggered with those on another side, to prevent the strength of the guide bar 1 from decreasing. The holes 9 are formed in a tapered configuration with the side walls 9*b* tilted to increase the width of the hole toward the bottom 9*a* similarly to the recess grooves 5, so that the light-weight filling material 7 is prevented from coming off.

Hollow pipes 6 running continuously from the lubricant supply port 4 to the tip portion 1B are installed in the recess grooves 5 and in the holes 9, while the space other than the hollow pipes 6 is filled with a light-weight filling material 7 to consolidate the hollow pipes 6 integrally with the guide bar 1, while the surfaces of the recess grooves 5 and the holes 9 are made flush with the surface of the guide bar 1. The filling material 7 is preferably constituted similarly to the case of the first embodiment.

According to the chain saw guide bar having a lubricant feeding structure L4 of the fourth embodiment constituted as described above, similarly to any of the embodiments described above, the hollow pipes 6 installed in the recess grooves 5 and in the holes 9 allow it to supply a sufficient quantity of lubricant to the tip portion 1B from the base end portion 1A of the guide bar 1 and, at the same time, the light-weight filling material 7 that fills the bottomed holes 9 provided on the recess grooves 5 enables it to reduce the weight of the guide bar 1 itself. Also because the arrangement to reduce the weight of the guide bar 1 is made on both sides thereof in the fourth embodiment, it is made possible to drastically reduce the weight of the guide bar 1.

In the fourth embodiment, similarly to the second and third embodiments, the guide bar can be configured to have an external appearance which is not different from a single steel plate at all, and the light-weight filling material 7 is stabilized in the recess grooves 5 showing sufficient strength even when used over a long period of time.

In the fourth embodiment, due to the light-weight filling material 7 that fills the recess grooves 5 and the hole 9 provided on both sides of the guide bar 1, bending due to a strain generated when the guide bar 1 is subjected to a great pressure applied on the side can be restrained with respect to the force in the opening direction and the force in the direction of compression by the toughness of the light-weight filling material 7 as well as the guide bar 1, similarly to the second and the third embodiments.

Figure 10:
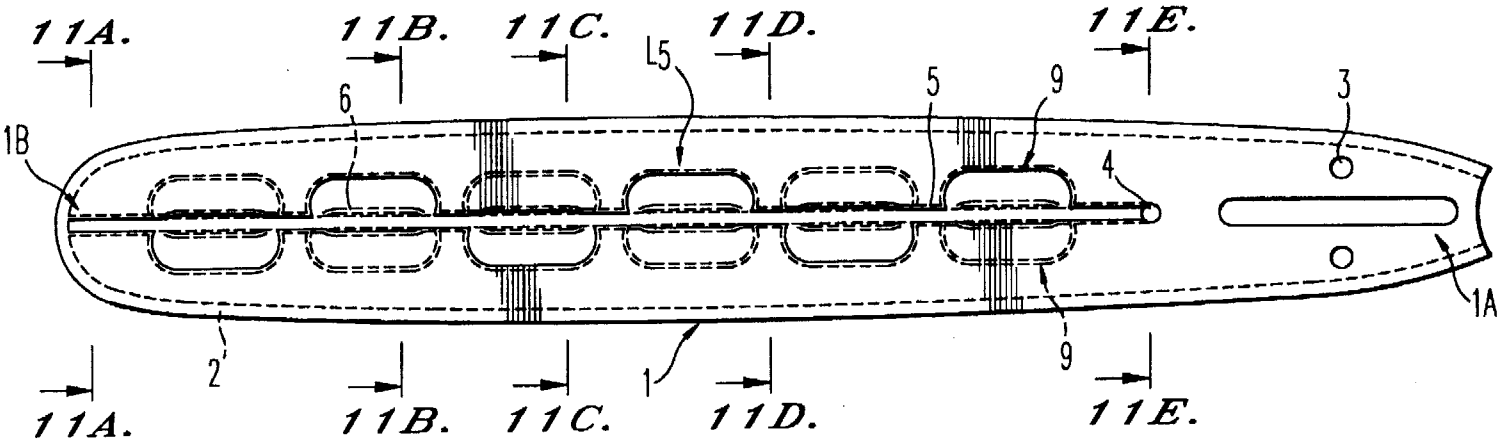
FIG. 10 is a side view showing a fifth embodiment of the invention.
Figures 11A, 11B, 11C, 11D, 11E:
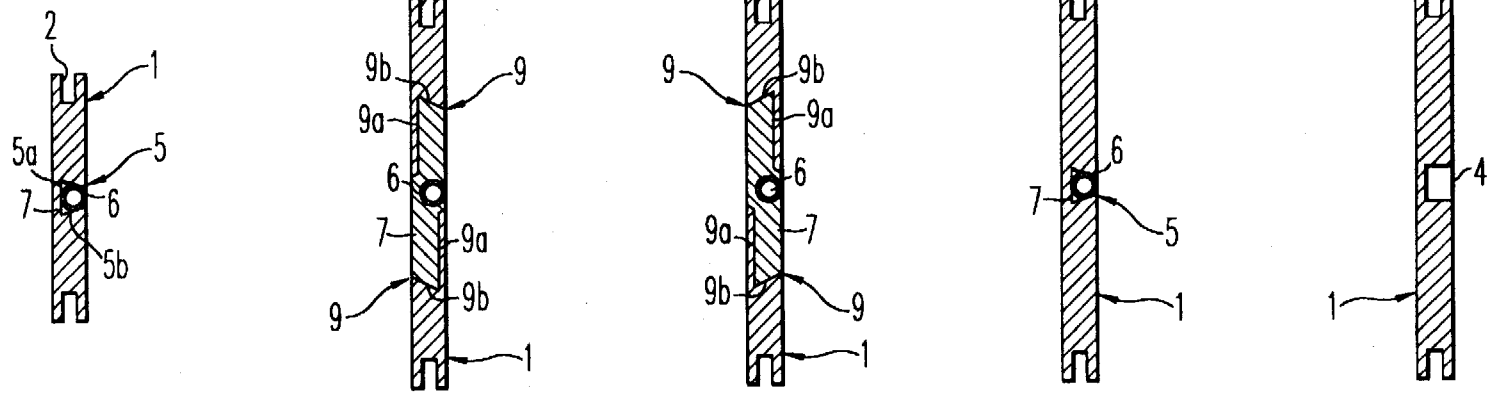
FIGS. 11(*a*), 11(*b*), 11(*c*), 11(*d*) and 11(*e*) are a set of sectional views of FIG. 10, FIG. 11(*a*) showing the 11*a*—11*a* section, FIG. 11(*b*) showing the 11*b*—11*b* section, FIG. 11(*c*) showing the 11*c*—11*c* section, FIG. 11(*d*) showing the 11*d*—11*d* section and FIG. 11(*e*) showing the 11*e*—11*e* section.

The chain saw guide bar having a lubricant feeding structure L5 of the fifth embodiment will be described below referring to the side view of FIG. 10 and the sectional view of FIGS. 11(*a*)–11(*e*), where FIG. 11(*a*) shows the view in 11*a*—11*a* section, FIG. 11(*b*) shows the view in 11*b*—11*b* section, FIG. 11(*c*) shows the view in 11*c*—11*c* section, FIG. 11(*d*) shows the view in 11*d*—11*d* section and FIG. 11(*e*) shows the view in 11*e*—11*e* section. In the fifth embodiment, a guide bar 1 is provided with a bottomed recess groove 5 made on the center line of the longitudinal direction and bottomed holes 9 of elongated elliptic shape each having a side edge positioned on the recess groove 5 and alternately made on each side of the guide bar 1. Because the volume of the light-weight filling material 7 can be made greater than in the case of the fourth embodiment, the weight of the guide bar 1 can be further reduced. Components identical with those of the first embodiment or the second embodiment will be denoted with the same numerals and explanation thereof will be omitted.

As shown in the drawings, the guide bar 1 made of a single steel plate has the recess groove 5 made on one side thereof running continuously on the longitudinal center line from the base end portion 1A to the tip portion 1B, and the bottomed holes 9 each having a side edge positioned on the recess groove 5 are grooved on both sides of the guide bar 1 to be connected at the center of the thickness of the guide bar 1. The holes 9 are positioned alternately on each side of the guide bar in order to drastically reduce the weight of the guide bar 1 while avoiding a decrease in the strength. The holes 9 are formed in a tapered configuration with the side walls 9*b* tilted to increase the width of the hole toward the bottom 9*a* similarly to the recess groove 5, so that the light-weight filling material 7 is prevented from coming off.

A hollow pipe 6 running continuously from the lubricant supply port 4 to the tip portion 1A is installed in the recess groove 5 and in the holes 9, while the space other than the hollow pipe 6 is filled with a light-weight filling material 7 to consolidate the hollow pipe integrally with the guide bar 1, and the surfaces of the recess groove 5 and the holes 9 are made flush with the surface of the guide bar 1. The filling material 7 is preferably constituted similarly to the case of the first embodiment.

According to the chain saw guide bar having a lubricant feeding structure L5 of the fifth embodiment constituted as described above, similarly to the fourth embodiment, the hollow pipe 6 installed in the recess groove 5 and the holes 9 allows it to supply a sufficient quantity of lubricant from the lubricant supply port 4 at the base end portion 1A of the guide bar 1 to the tip end portion 1B of the guide bar 1 and, at the same time, the light-weight filling material 7 that fills the bottomed holes 9 provided on the recess groove 5 enables it to reduce the weight of the guide bar 1 itself.

In the fifth embodiment, similarly to the second through fourth embodiments, the guide bar can be configured to have an external appearance which is not different from a single steel plate at all, and the light-weight filling material 7 is stabilized in the recess groove 5 showing sufficient strength even when used over a long period of time.

In the fifth embodiment, due to the light-weight filling material 7 that fills the recess groove 5 provided on one side of the guide bar 1 and the holes 9 that connect to the recess groove 5 from both sides, bending due to a strain generated when the guide bar 1 is subjected to a great pressure applied on the side can be restrained with respect to the force in the opening direction and the force in the direction of compression by the toughness of the light-weight filling material 7 together with the guide bar 1, similarly to the second and the third embodiments.

Figure 12:
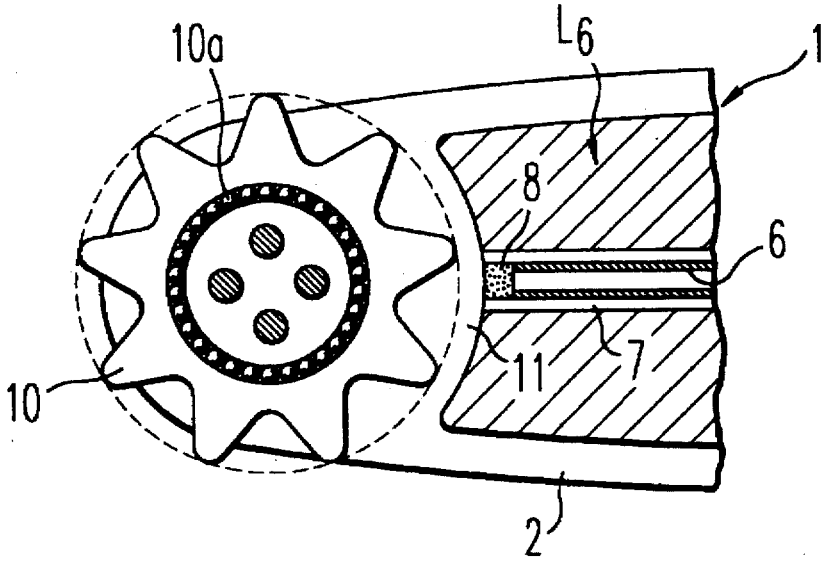
FIG. 12 is a sectional view of the guide bar end portion of a sprocket type.

There is a variation of the chain saw guide bar which has a sprocket at the tip portion 1B of the guide bar 1 unlike the embodiments described above. The sprocket type chain saw guide bar of the sixth embodiment will be described below referring to FIG. 12 which shows the sectional view at the tip portion of the guide bar. Because the sixth embodiment is different only in the structure of the tip portion 1B in the first embodiment, only the sectional view of the tip portion will be shown with components identical with those of the first embodiment being denoted with the same numerals and detailed explanation thereof being omitted.

As shown in the drawing, a sprocket housing 11 is cut out in the tip portion 1B of the guide bar 1 to allow a sprocket 10 to freely rotate on a bearing 10*a*, and a bottomed recess groove 5 is provided to run up to the sprocket housing 11, namely to near the sprocket 10, similarly to the first embodiment. While the recess groove 5 will not be described in detail because it is similar to that in the first embodiment, a hollow pipe 6 is installed in the recess groove 5 with the space therebetween being filled with a light-weight filling material 7.

According to the chain saw guide bar having a lubricant feeding structure L6 of the sixth embodiment constituted as described above, similarly to the first embodiment, the hollow pipe 6 running continuously in the recess groove 5 allows it to supply a sufficient quantity of lubricant directly to the tip portion 1B of the guide bar 1 from the lubricant supply port 4 installed at the base end portion 1A of the guide bar 1 thereby providing reliable lubrication to the sprocket 10 and the bearing 10*a*. Also because the guide bar can be configured to have an external appearance which is not different from a guide bar comprising a single plate at all, the guide bar can be handled similarly to the conventional ones and, because the recess groove 5 is formed so that side walls 5*b* are tilted to increase the width of the groove toward the bottom 5*a*, the light-weight filling material 7 filling the recess groove 5 is stabilized so that it does not come off after being used over a long period of time and shows sufficient strength.

The configuration of the sixth embodiment may also be combined with any of the configuration of the second through fifth embodiments, in which case the effects of the second through fifth embodiments can be achieved.

According to the present invention, as described above, the strength of the guide bar itself does not decrease much because the guide bar 1 is configured to be continuous on the bottom side of the recess groove 5 or the hole 9, and the light-weight filling material 7 is subjected to less wear because only a part of the light-weight filling material 7 is exposed on the guide bar surface, thus the lubricant feeding structure of the chain saw guide bar which can endure use over an extended period of time can be made.

In addition, because the bottomed holes 9 that are continuously connected with the recess groove 5 are provided by grooving on the guide bar surface to increase the width toward the bottom while the space in the holes 9 is filled with the light-weight filling material 7, it is possible to reduce the weight of the guide bar 1 and, because the light-weight filling material 7 that fills the holes 9 and the recess groove 5 is continuous, the hollow pipe 6 can be securely consolidated with the guide bar 1. Furthermore, because the side walls of the recess groove 5 and the holes 9 are tilted to increase the width toward the bottom, the light-weight filling material 7 is stabilized so that it does not come off.

Also because the lubricant supply can be directly concentrated from the lubricant supply port 4 of the guide bar 1 most effectively without leakage and blockage in the course to the end portion 1A in the longitudinal direction of the guide bar where heat generation and wear of the rotary sliding between the guide bar and the saw chain occur most severely, the lubricant is guided in the running direction of the saw chain without splashing and wear of both the saw chain and the slide way of the guide bar where the saw chain runs is minimized by supplying proper lubricant to the slide way.

Further, provision of the dust-proof filter 8 enables it to surely prevent the entry of cut chips and dust from the end of the hollow pipe 6 thereby facilitating smooth operation. By making slits at the end of the hollow pipe 6, certain extent of dust-proofness can be achieved without installing the dust-proof filter 8 depending on the application.

The present invention is not restricted to the embodiments described above, and effects similar to those described above can be achieved by combining bottomed recess groove(s) 5 and hollow pipe(s) 6, or combining bottomed recess groove (s) 5, bottomed hole(s) 9 and hollow pipe(s) 6 and consolidating them by means of a light-weight filling material 7.

According to the chain saw guide bar having a lubricant feeding structure of the present invention, because the hollow pipe is installed in the bottomed recess groove made in the guide bar surface of single plate structure and the recess groove is filled with a light-weight filling material to consolidate the hollow pipe with the guide bar, the external shape can be made similar to a chain saw guide bar made of a single plate and the lubricant can be supplied to the tip portion of the guide bar through the hollow pipe that runs continuously from the lubricant supply port to the tip portion. This thereby makes it possible to provide sufficient lubrication to the tip portion of the guide bar.

Also because the side walls of the recess groove are tilted to increase the width of the recess toward the bottom, the light-weight filling material that fills the recess groove is stabilized so that it does not come off, making it possible to constitute a chain saw guide bar that shows sufficient strength after being used over a long period of time.

According to a further feature of the chain saw guide bar having a lubricant feeding structure, because the hollow pipe is installed in the bottomed recess groove made in the guide bar surface of a single steel plate structure and the recess groove is filled with the light-weight filling material to consolidate the hollow pipe with the guide bar, the external shape can be made similar to a chain saw guide bar made of a single steel plate and the lubricant can be supplied to the tip portion of the guide bar through the hollow pipe that runs continuously from the lubricant supply port to the tip portion. This thereby makes it possible to provide sufficient lubrication to the tip portion of the guide bar.

Also because the side walls of the recess groove and the holes are tilted to increase the widths of the groove and the holes toward the bottom, the light-weight filling material that fills the recess groove and the holes is stabilized so that it does not come off. This makes it possible to constitute a chain saw guide bar that shows sufficient strength after being used over a long period of time. In addition, the bottomed holes provided on the bottomed recess groove reduce the weight of the guide bar and make it possible to consolidate the entire light-weight filling material thereby further increasing the strength.

According to a further feature of the chain saw guide bar having a lubricant feeding structure, because the hollow pipe is installed in the bottomed recess grooves made in the guide bar surface of single steel plate structure and in the bottomed hole that connects the bottomed recess grooves at the mid-portion, and the recess grooves and the hole are filled with the light-weight filling material to consolidate the hollow pipe integrally with the guide bar, the external shape can be made similar to a chain saw guide bar made of a single steel plate and the lubricant can be supplied to the tip portion of the guide bar through the hollow pipe that runs continuously from the lubricant supply port to the tip portion. This thereby makes it possible to provide sufficient lubrication to the tip portion of the guide bar.

Also because the side walls of the recess grooves and the hole are tilted to increase the widths of the grooves and the hole toward the bottom, the light-weight filling material that fills the recess grooves and the hole is stabilized so that it does not come off. This makes it possible to constitute a chain saw guide bar that shows sufficient strength after being used over a long period of time. In addition, the bottomed hole provided on the bottomed recess groove reduces the weight of the guide bar and makes it possible to consolidate the entire light-weight filling material thereby further increasing the strength.

According to a further feature of the chain saw guide bar having a lubricant feeding structure, because the hollow pipes are installed in the bottomed recess grooves made on both sides of the guide bar surface of the single steel plate structure and in the bottomed holes provided over these recess grooves while the space is filled with the light-weight filling material to consolidate the hollow pipes with the guide bar, the external shape can be made similar to a chain saw guide bar made of a single steel plate and the lubricant can be supplied to the tip portion of the guide bar through the hollow pipe that runs continuously from the lubricant supply port to the tip portion. This thereby makes it possible to provide sufficient lubrication to the tip portion of the guide bar.

Also because the side walls of the recess grooves and the holes are tilted to increase the widths of the grooves and the holes toward the bottom, the light-weight filling material that fills the recess grooves and the holes is stabilized so that it does not come off. This makes it possible to constitute a chain saw guide bar that shows sufficient strength after being used over a long period of time. In addition, the bottomed holes provided over the bottomed recess grooves reduce the weight of the guide bar and make it possible to consolidate the entire light-weight filling material thereby further increasing the strength.

According to a further feature of the chain saw guide bar having a lubricant feeding structure, because the hollow pipe is installed in the bottomed recess groove made on one side of the guide bar of a single steel plate structure and in the bottomed holes that connect to the recess groove, while the space is filled with the light-weight filling material to consolidate the hollow pipe with the guide bar, the external shape can be made similar to a chain saw guide bar made of a single steel plate and the lubricant can be supplied to the tip portion of the guide bar through the hollow pipe that runs continuously from the lubricant supply port to the tip portion. This thereby makes it possible to provide sufficient lubrication to the tip portion of the guide bar.

Also because the side walls of the recess groove and the holes are tilted to increase the widths of the groove and the holes toward the bottom, the light-weight filling material that fills the recess groove and the holes is stabilized so that it does not come off. This makes it possible to constitute a chain saw guide bar that shows sufficient strength after being used over a long period of time. In addition, the bottomed holes provided to connect to the bottomed recess groove reduce the weight of the guide bar and make it possible to consolidate the entire light-weight filling material thereby further increasing the strength.

According to a further feature of the chain saw guide bar having a lubricant feeding structure, with a chain saw guide bar made of a single metal plate having a sprocket at the tip portion, the sprocket installed at the tip portion of the guide bar and other parts can be sufficiently lubricated because the lubricant can be supplied to the end of the guide bar through the hollow pipe by means of the bottomed recess groove provided up to the tip portion near the sprocket.

According to a further feature of the chain saw guide bar having a lubricant feeding structure, the dust-proof filter installed at the end of the hollow pipe makes it possible to prevent cut chips and other foreign matters from entering the hollow pipe and blocking the passage.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A chain saw guide bar having a lubricant feeding structure, wherein:

the chain saw guide bar comprises a single plate and is provided with a lubricant supply port made in a base end portion of a guide bar surface of the chain saw guide bar;

a bottomed recess groove runs continuously from the lubricant supply port to a tip portion of the chain saw guide bar, the recess groove having side walls which are tilted to increase a width of a cross section of the recess groove toward a bottom of the recess groove;

a hollow pipe runs continuously from the lubricant supply port to the tip portion, the hollow pipe being installed in the recess groove;

the recess groove is filled with a light-weight filling material to thereby consolidate the hollow pipe integrally with the chain saw guide bar;

a dust-proof filter is installed at an end of the hollow pipe.

2. A chain saw guide bar having a lubricant feeding structure according to claim 1, wherein the light-weight filling material is a synthetic resin.

3. A chain saw guide bar having a lubricant feeding structure according to claim 1, wherein the single plate of the chain saw guide bar is a metal plate, and the chain saw guide bar comprising the single metal plate has a sprocket at the tip potion with the bottomed recess groove being provided running to the tip portion near the sprocket.

4. A chain saw guide bar having a lubricant feeding structure, wherein:

the chain saw guide bar comprises a single plate and is provided with a lubricant supply port made in a base end portion of a guide bar surface of the chain saw guide bar;

a bottomed recess groove runs continuously from the lubricant supply port to a tip portion of the chain saw guide bar, and bottomed holes are located on the bottomed recess groove, the recess groove and bottomed holes having side walls which are tilted to increase a width of cross sections of the recess groove and the holes toward a bottom of the recess groove and the holes;

a hollow pipe runs continuously from the lubricant supply port to the tip portion, the hollow pipe being installed in the recess groove and the holes;

the recess groove and the holes are filled with a light-weight filling material to thereby consolidate the hollow pipe integrally with the guide bar; and a dust-proof filter is installed at an end of the hollow pipe.

5. A chain saw guide bar having a lubricant feeding structure according to claim 4, wherein the light-weight filling material is a synthetic resin.

6. A chain saw guide bar having a lubricant feeding structure according to claim 4, wherein the single plate of the chain saw guide bar is a metal plate, and the chain saw guide bar comprising the single metal plate has a sprocket at the tip portion with the bottomed recess groove being provided running to the tip portion near the sprocket.

7. A chain saw guide bar having a lubricant feeding structure, wherein:

the chain saw guide bar comprises a single plate and is provided with a lubricant supply port made in a base end portion of the guide bar;

a first bottomed recess groove runs continuously from the mid-portion of the guide bar;

a second bottomed recess groove runs continuously from the mid-portion to a tip portion on an opposite side of a guide bar surface of the guide bar;

a bottomed hole is positioned at the mid-portion of the guide bar surface on one side of the guide bar to connect the first and the second recess grooves, the first and the second recess grooves and the bottomed hole having side walls which are tilted to increase widths of cross sections of the first and the second recess grooves and the hole toward a bottom of the first and the second recess grooves and the hole;

a hollow pipe runs continuously from the base end portion to the tip portion and is installed in the first and the second recess grooves and the hole; and the first and the second recess grooves and the hole are filled with a light-weight filling material to thereby consolidate the hollow pipe integrally with the guide bar.

8. A chain saw guide bar having a lubricant feeding structure according to claim 7, wherein the light-weight filling material is a synthetic resin.

9. A chain saw guide bar having a lubricant feeding structure according to claim 7, wherein the single plate of the chain saw guide bar is a metal plate, and the chain saw guide bar comprising the single metal plate has a sprocket at the tip portion with the bottomed recess groove being provided running to the tip portion near the sprocket.

10. A chain saw guide bar having a lubricant feeding structure according to claim 7, wherein a dust-proof filter is installed at an end of the hollow pipe.

11. A chain saw guide bar having a lubricant feeding structure, wherein:

the chain saw guide bar comprises a single plater and is provided with lubricant supply ports made in a base end portion on both sides of the guide bar;

bottomed recess grooves run continuously from the lubricant supply ports to a tip portion of the guide bar;

bottomed holes are located on the bottomed recess grooves with side walls of the holes and the recess grooves being tilted to increase widths of cross sections of the holes and the recess grooves toward a bottom of the recess grooves and the holes;

hollow pipes run continuously from the lubricant supply ports to the tip portion and are installed in the recess grooves and the holes;

the recess grooves and the holes are filled with a light-weight filling material to thereby consolidate the hollow pipes integrally with the guide bar; and a dust-proof filter is installed at an end of at least one of the hollow pipes.

12. A chain saw guide bar having a lubricant feeding structure according to claim 11, wherein the light-weight filling material is a synthetic resin.

13. A chain saw guide bar having a lubricant feeding structure according to claim 11, wherein the single plate of the chain saw guide bar is a metal plate, and the chain saw guide bar comprising the single metal plate has a sprocket at the tip portion with the bottomed recess groove being provided running to the tip portion near the sprocket.

14. A chain saw guide bar having a lubricant feeding structure, wherein:

the chain saw guide bar comprises a single plate and is provided with a lubricant supply port made in a base end portion on one side of the guide bar;

a bottomed recess groove runs continuously from the lubricant supply port to a tip portion of the guide bar;

bottomed holes are grooved on both sides of the guide bar to connect to the bottomed recess groove, with side walls of the recess groove and the bottomed holes being tilted to increase widths of cross sections of the groove and the holes toward a bottom of the groove and the holes;

a hollow pipe runs continuously from the base end portion to the tip portion and is installed in the recess groove and the holes;

the recess groove and the holes are filled with a light-weight filling material to thereby consolidate the hollow pipe integrally with the guide bar; and a dust-proof filter is installed at an end of the hollow pipe.

15. A chain saw guide bar having a lubricant feeding structure according to claim 14, wherein the light-weight filling material is a synthetic resin.

16. A chain saw guide bar having a lubricant feeding structure according to claim 14, wherein the single plate of the chain saw guide bar is a metal plate, and the chain saw guide bar comprising the single metal plate has a sprocket at the tip portion with the bottomed recess groove being provided running to the tip portion near the sprocket.

* * * * *